United States Patent [19]

Keough

[11] Patent Number: 4,482,316

[45] Date of Patent: Nov. 13, 1984

[54] INSULATED ATMOSPHERE FURNACE

[75] Inventor: William R. Keough, Bloomfield Hills, Mich.

[73] Assignee: Atmosphere Furnace Company, Wixom, Mich.

[21] Appl. No.: 456,490

[22] Filed: Jan. 7, 1983

[51] Int. Cl.[3] ..... F27B 5/04; F27B 9/04; F27B 3/22; F27D 1/14

[52] U.S. Cl. ..... 432/198; 432/23; 432/26; 432/252

[58] Field of Search ..... 432/23, 26, 198, 252

[56] References Cited

U.S. PATENT DOCUMENTS

| | | | |
|---|---|---|---|
| 2,246,322 | 6/1941 | Roth | 432/23 |
| 2,828,813 | 4/1958 | Holden | 431/170 |
| 4,244,686 | 1/1981 | Scott, Jr. | 432/26 |

*Primary Examiner*—J. Camby
*Attorney, Agent, or Firm*—H. P. Settle

[57] ABSTRACT

A heat treat furnace wherein the furnace top and side walls are each defined by an outer, gas-tight metallic structural wall, an intermediate perforate metal plate generally parallel to and coextensive with the exterior wall to define a plenum chamber therebetween, and an inner layer of non-metallic, gas permeable insulation, preferably a blanket insulation of appreciable thickness. The gaseous atmosphere of the furnace is injected into the plenum chambers defined between the exterior walls and the perforate plates, and the atmosphere passes through the insulation layer into the interior of the furnace. The inward flow of atmospheric gas (1) replenishes the atmosphere in the furnace, (2) preheats the atmosphere, and (3) reduces any heat loss through the wall structure.

3 Claims, 3 Drawing Figures

INSULATED ATMOSPHERE FURNACE

BACKGROUND OF THE INVENTION

Heat treat furnaces of the type herein contemplated generally are constructed with an exterior metal shell lined with solid refractory insulating bricks or blocks. The furnaces typically operate at temperatures in excess of about 1200° F. and an appreciable thickness of insulating block is necessary to avoid excessive heat losses through the furnace walls. For example, in a furnace operating at 1800° F. in an ambient temperature of 80° F., a structural wall made up of 9 inches of insulating fire brick (K-23 brick, manufactured by Babcock & Wilcox) and two inches of block insulation (Johns-Manville Superex M) has a heat loss per square foot of wall area of 310 B.T.U., the exterior metal wall temperature of 213° F., and the interface temperature between the insulating fire brick and the block wall will be 660° F. The cost of the heat loss and fuel consumption in a large furnace and the ambient air heating effect from the exterior wall temperature of 230° F. will be readily appreciated.

It has been proposed, as in U.S. Pat. No. 2,828,813 to A. F. Holden, that a furnace be lined with permeable fire brick spaced from the exterior metallic casing to define a plenum chamber. A combustible gas-air mixture is introduced into the plenum chamber. The combustible mixture burns at the interior lining surface of the furnace after it has been pre-heated by passing through the permeable fire brick lining. Such luminous wall furnaces have been utilized commercially, albeit for limited purposes due to the restriction placed upon the atmospheres with which it may be utilized.

BRIEF DESCRIPTION OF THE PRESENT INVENTION

The heat treat furnace of the present invention is provided with a novel top and side wall construction. More specifically, the top and side walls of the furnace each comprise an exterior metallic structural wall, a perforate metallic plate spaced from the exterior wall to define a plenum chamber therebetween and an inner layer of non-metallic, gas-permeable insulation, preferably a blanket insulation of appreciable thickness.

The floor of the furnace which carries the remainder of the furnace structure thereon and at least a portion of the door wall of the furnace, providing access to the interior of the furnace, may be constructed of conventional insulating fire brick elements.

The atmosphere to be utilized in the interior of the furnace, which may be either endothermic or exothermic, is injected into the plenum chambers provided between the exterior wall casing and the interior perforate metal plate, and this atmosphere flows through the insulating batt into the interior of the furnace. The atmosphere is injected at either a single location which provides atmosphere to a single plenum chamber surrounding the interior heat treat space or is injected at several distinct locations into individual plenum chambers provided at the individual side and top walls.

By so injecting the atmosphere into the plenum chamber and flowing the atmosphere into the interior heat treat space defined in the furnace, several functional advantages are obtained over the prior art heat treat furnaces. For example, the atmosphere flows into the plenum chamber under positive pressure and serves to replenish the atmosphere in the furnace. As the atmosphere flows through the insulating batt and into the furnace interior, it is pre-heated by heat exchange with the insulating batts. Finally, and most importantly, the flow of atmosphere from the chamber inwardly into the interior heat treat space reduces heat losses through the wall structure to a remarkable extent.

ON THE DRAWINGS

DETAILED DESCRIPTION OF THE PRESENT INVENTION

Figure 1:
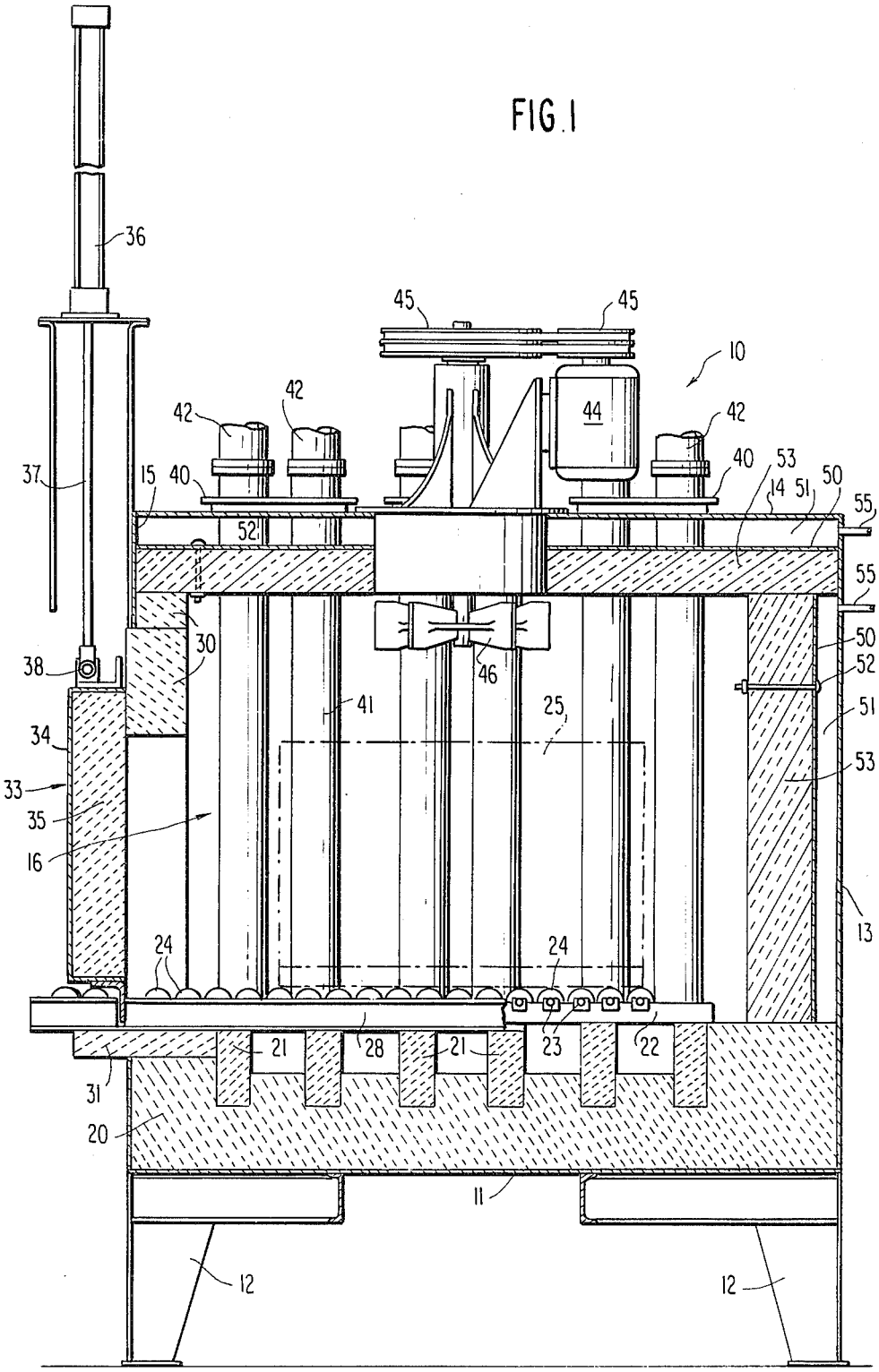
FIG. 1 is a vertical sectional view, with parts shown in elevation, of the furnace provided with side and end walls in accordance with the present invention.
Figure 3:
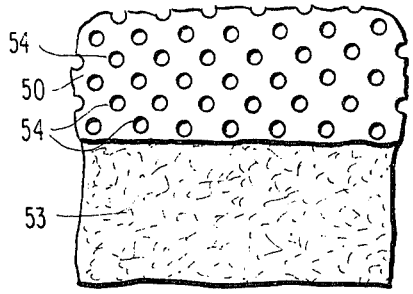
FIG. 3 is a fragmentary sectional view taken along the plane 3—3 of FIG. 2.
Figure 2:
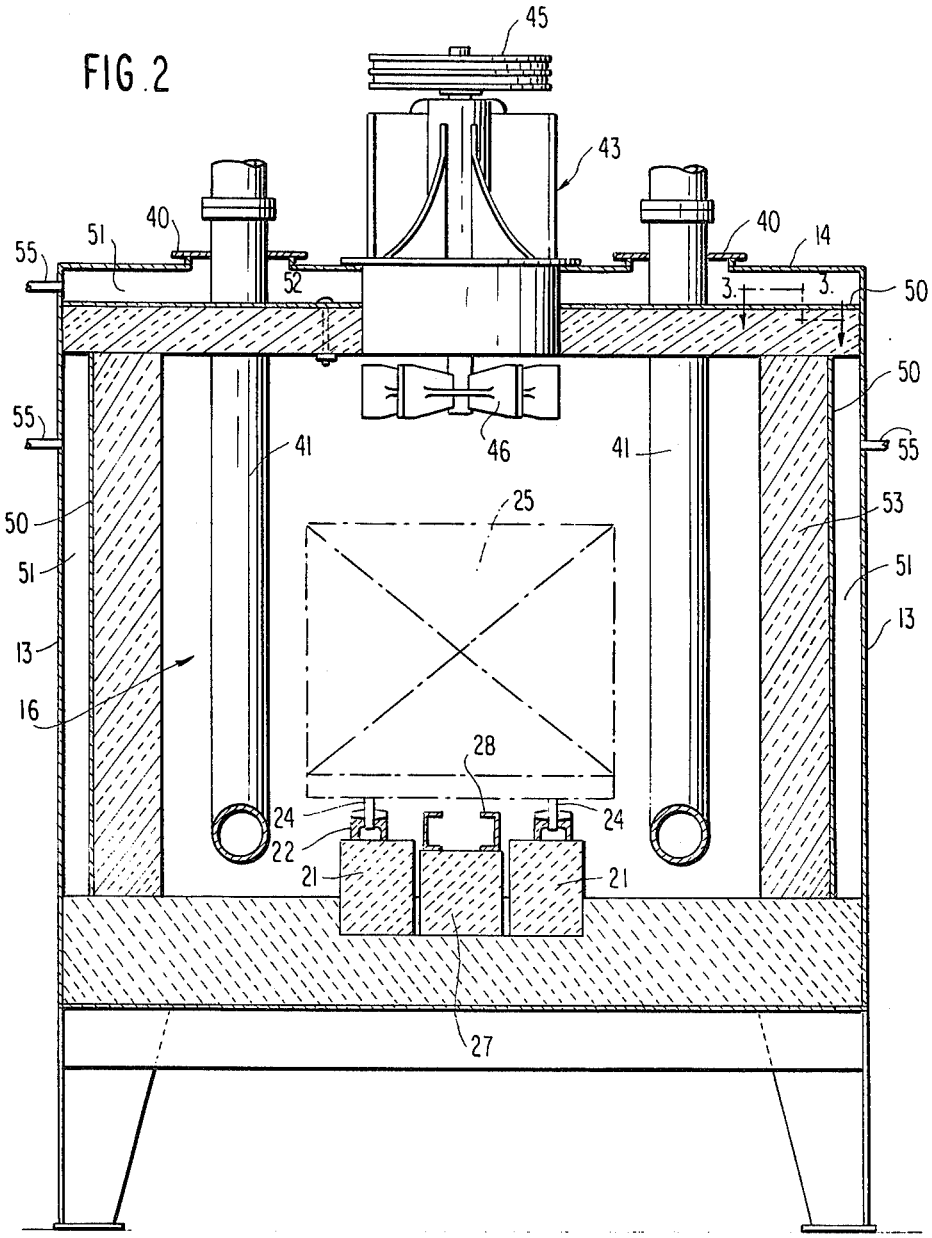
FIG. 2 is a vertical sectional view similar to FIG. 1 but taken at 90° thereto.

As illustrated in FIGS. 1, 2 and 3, the present invention is incorporated into an exterior metal casing comprising a lower exterior metal wall 11 supported on legs 12, side and rear walls 13 and a top wall 14. A front or door wall 15 completes the exterior casing of the furnace and provides an access opening to the interior 16 of the furnace. The bottom wall 11 is lined with insulating fire brick 20 and upstanding refractory supports 21 support longitudinally extending rails 22 located in the space 16 and provided with open-topped seats 23 upon which load-supporting rollers 24 are mounted. The rollers 24 are disposed in the heat treat space 16 and support a container or box 25 containing the parts to be heat treated.

A central block 27 disposed between the two roller support blocks 21 supports an open-topped channel 28 on its upper surface. This channel 28 is adapted to receive a conventional pusher chain (not shown) engageable with the box 25 and serving to move it in and out of the interior space 16 as it is supported on the rollers 24.

Access to the space 16 is provided by a front closure wall defined by upper refractory blocks 30 and a lower refractory support block 31 which also serves to support the rails 22 and the channel 28 as they extend through the access opening. A vertically movable access door 33 is provided in the front wall of the furnace. This door 33 includes a metallic frame 34 lined with refractory insulation 35. The door is actuated vertically by a fluid pressure actuated cylinder 36 which is vertically disposed and which has its actuating rod 37 secured to the upper portion of the door frame, as at 38. The access opening closed by the door 33 is circumscribed by refractory materials similar to the blocks 30 to provide a solid sealing surface for the door 33 when closed and to structurally support the door.

The top wall 14 is provided with a plurality of fittings 40 through which U-shaped heating tubes 41 formed of high-temperature alloy project downwardly into the furnace. The tubes are U-shaped, having vertical legs which extend throughout the entire vertical extent of the heating space 16 and lower joining bight portions at their lower ends. The upper ends of the tube legs are connected, respectively, to an air-gas burner and to the furnace exhaust system through upper conduits 42. The upper wall 14 is centrally apertured to receive a circulating fan indicated generally at 43. The fan driving mechanism is located on top of the wall 14, and this driving mechanism includes a drive motor 44 and a pair of sheaves 45 for rotating the fan impeller 46 which is located centrally within the heating space 16 and above the parts container 25.

The side and rear walls 13 and the top wall 14 each have a fixed perforate metallic plate 50 spaced inwardly therefrom and extending parallel thereto, and each plate 50 cooperates with the exterior casing wall 13, 14 to define a plenum chamber 51 therebetween. Secured to the inner face of each of the plates 50 by suitable fastening means 52 is a blanket of gas-permeable, non-metallic insulation 53. Preferably, the insulating blanket 53 is formed of ceramic fibers and the blanket is secured to each of the plates 50 by conventional blanket insulation fastening means 52 at a number of locations, only representative examples of which are shown in the drawings. The blanket insulation is readily available commercially, and suitable examples include Carborundum Durablanket (manufactured by Carborundum Co., Niagara Falls, N.Y.); B & W Kaowool Blanket (manufactured by Babcock & Wilcox, Augusta, Ga.); Cer-Wool Blanket (manufactured by C & F Refractories, Irwin, Tenn.); or Cera Blanket (manufactured by Johns-Manville Corporation, Denver, Colo.).

The atmosphere internally of the space 16 can be any desired atmosphere, i.e., endothermic or exothermic. The atmosphere, of either type, within the space 16 is supplied to the plenum chambers 51 defined between the perforate plate 50 and the exterior walls 13, 14 by inlet pipes 55 communicating with the atmosphere source, such as an endothermic generator or an exothermic generator. The atmosphere supplied to the plenum chambers 51 flows through the apertures 54 in the plate 50 (FIG. 3) and through the gas-permeable insulation blanket 53 into the heating space 16 to replenish the atmosphere in the space 16. Both the perforate plate 50 and the insulating blanket 53 are, of course, heated by convection and conduction from the space 16, and the atmosphere introduced into the plenum chamber 51 and flowing through the blanket 53 is heated by its contact with the plate 50 and the blanket 53 during its flow therethrough. Further, the atmosphere gap provided by the atmosphere in the plenum chamber 51 and the flow of the atmosphere through the blanket 53 into the space 16 substantially reduces the heat losses through the composite furnace casing, as will be evident from the following example:

EXAMPLE

The following data was obtained, utilizing a furnace as illustrated in FIGS. 1–3 and as above described. The furnace interior space 16 was approximately 6′ wide, 6′ long and 5′4″ high. The furnace was lined with 9 inches of blanket insulation manufactured by Babcock & Wilcox, Augusta, Ga., and sold under the trade name "Kaowool Blanket." A 3-inch atmosphere gap was provided between each plate and the adjacent metallic wall. The door was lined with 9 inches of K-23 insulating firebrick manufactured by Babcock & Wilcox of Augusta, Ga.

The furnace was operated continuously for 68 hours and the following data was obtained:

Furnace Atmosphere: Nitrogen
Atmosphere Flow: 500 cubic feet/hour total
Furnace Internal Temperature: 1750° F.
Exterior Wall Casing Temperature: 120° F.
Perforated Plate Temperature: 180° F.
Door Shell Exterior Temperature: 230° F.
Ambient Temperature: 70° F.

The manufacturer's published data for the blanket insulation indicated that the 9 inches of blanket insulation at a 1750° F. internal furnace temperature in 70° F. ambient air should have a heat loss of 160 B.T.U./hour/square foot area or a 155° F. temperature at the external, cold face of the insulation blanket. The actual cold face temperature was 180° F. (perforated plate temperature) which equals a heat loss of 215 B.T.U./hour/square foot area. The primary reason for this difference is due to heat conduction through the metal blanket anchors retaining the blanket insulation in place.

The correction factor from the manufacturer's published data to compensate for hanger conduction is:

$$\frac{215 \text{ (the observed temperature)}}{160 \text{ (the published temperature)}} = 1.34$$

Thus, the published data should be multiplied by 1.34 to estimate the actual heat loss through installed blanket insulation.

The accuracy of the observed temperatures is confirmed by the heat loss through the door which was fully insulated with 9 inches of K-23 brick. The theoretical heat loss (as determined from the manufacturer's published data) should be 235 B.T.U./hour/square foot. The actual heat loss obtained by measurement was 350 B.T.U./hour/square foot. The correction factor between theoretical and actual heat loss is:

$$\frac{350}{235} = 1.49$$

The commonly-accepted correction factor for these conditions is 1.5.

Thus, it appears that the measurements of actual heat loss in both the blanket insulation of the furnace walls and the brick insulation of the door were accurate.

The measured heat loss through the combination of 9-inch blanket insulation plus the 3-inch air gap (external wall casing temperature of 120° F.) equals 80 B.T.U./hour/square foot.

The insulating efficiency of the furnace wall structure of this invention was determined as follows:

| | | |
|---|---|---|
| Measured Heat Loss in 9″ Blanket | = | 215/B.T.U./hour/square foot |
| Measured Heat Loss in 9″ Blanket and 3″ Atmosphere Blanket | = | 80 B.T.U./hour/square foot |
| Insulating Value of 3″ Atmosphere Gap | = | 135 B.T.U./hour/square foot |

The reduction in heat loss through the furnace wall attributable to the 3-inch atmosphere gap is:

$$\frac{135}{215} \times 100 = 63\%$$

It is claimed:

1. In a heat treatment furnace of the type having a closed interior space in which metallic articles are heat treated in a heated, gaseous treatment atmosphere, the improvement of a furnace wall construction of enhanced insulating value comprising:

(a) an exterior gas-tight metallic structural wall defining at least a part of the enclosure for said interior space;

(b) a perforate metallic plate generally parallel to and substantially coextensive with said exterior wall and spaced therefrom toward said interior space;

(c) a non-metallic, gas-permeable, refractory insulation blanket of appreciable thickness secured to the interior surface of said perforate plate, the inner surface of said blanket defining one entire wall of said interior space and said inner surface being fully exposed to the heated atmosphere in said interior space to be heated thereby; and (d) means for injecting the gaseous treatment atmosphere under pressure into the space between said exterior structural wall and the perforate plate;

the injected treatment atmosphere flowing from said space between said exterior structural wall and the perforate plate through the perforate plate and said gas-permeable insulation blanket into the interior space of said furnace, and the gaseous atmosphere being heated by the insulation blanket as it flows therethrough (1) to replenish the gaseous treatment atmosphere in the furnace interior, (2) to preheat the replenishment atmosphere, and (3) to reduce any heat loss outwardly through said wall construction.

2. In a heat treatment furnace of the type having a closed interior space in which metallic articles are heat treated in a heated gaseous treatment atmosphere, the improvement in which the side walls and the top wall of said furnace each comprise:

(a) a gas-tight exterior structural metal wall;

(b) a perforate heat-resistant interior wall generally parallel to said exterior wall and spaced therefrom to define a gas plenum chamber therebetween;

(c) non-metallic, gas-permeable, refractory, fibrous insulation batt of appreciable thickness secured to the inner surface of the interior wall and coextensive therewith, the insulation blanket lining the interior surface of the furnace space and being fully exposed to said space to be heated by the heated atmosphere therein; and (d) means for flowing gaseous treatment atmosphere under pressure into the gas plenum chamber for passage through the heated gas-permeable insulation blanket directly into the closed interior furnace space.

3. In a heat treatment furnace having an interior heat treatment space in which metallic articles are heated in a gaseous treatment atmosphere, the improvements of an insulating means partially defining said interior space and comprising a gas-tight exterior wall, a gas-permeable interior metallic wall spaced from said exterior wall to define a plenum chamber therebetween, a gas-permeable ceramic fiber insulation batt carried by said interior wall and coextensive therewith, said batt having its inner surface fully exposed to said heat treatment space, and means for injecting additional heat treatment atmosphere under pressure into said plenum chamber for flow through said interior wall and said insulation batt into said interior heat treatment space.

* * * * *